US005221023A

United States Patent [19]

Dubik

[11] Patent Number: 5,221,023

[45] Date of Patent: Jun. 22, 1993

[54] PROCESS AND APPARATUS FOR THE AUTOMATIC DISPENSING OF PRODUCTS, ESPECIALLY OF FOOD PRODUCTS, IF NECESSARY REHEATED

[76] Inventor: Andre S. Dubik, 44 Avenue La Bruyère, F-38100 Grenoble, France

[21] Appl. No.: 898,844

[22] Filed: Jun. 15, 1992

Related U.S. Application Data

[63] Continuation of Ser. No. 417,968, Oct. 10, 1989, Pat. No. 5,147,069.

[30] Foreign Application Priority Data

Oct. 10, 1988 [FR] France ..... 88 13287

[51] Int. Cl.[5] ..... G07F 11/00

[52] U.S. Cl. ..... 221/1; 221/79; 221/87; 221/133; 221/150 HC; 221/150 A; 221/236

[58] Field of Search ..... 221/150 R, 150 HC, 150 A, 221/76, 79, 87, 259, 236, 224, 192, 133, 121, 119, 1; 99/352, 357, 443 R, 443 C, 484

[56] References Cited

U.S. PATENT DOCUMENTS

| | | | |
|---|---|---|---|
| 3,227,501 | 1/1966 | Austin et al. | 221/150 HC X |
| 3,333,666 | 8/1967 | Murray et al. . | |
| 3,534,676 | 10/1970 | Rubino | 221/150 HC X |
| 3,620,341 | 11/1971 | Gardner | 221/150 HC X |
| 4,274,551 | 6/1981 | Hicks | 221/78 |
| 4,349,714 | 9/1982 | Tamano . | |
| 4,677,278 | 6/1987 | Knoll | 221/150 R X |

FOREIGN PATENT DOCUMENTS

| | | |
|---|---|---|
| 0184655 | 8/1986 | European Pat. Off. . |
| 2587306 | 3/1987 | France . |
| 8504743 | 10/1985 | PCT Int'l Appl. . |

*Primary Examiner*—David H. Bollinger
*Attorney, Agent, or Firm*—Beveridge, DeGrandi, Weilacher & Young

[57] ABSTRACT

Process for the automatic dispensing and automatic dispenser (1) of products (63), in particular of packaged food products, arranged on trays (20) of a storage device (2) comprising means (3) for transportation in a closed circuit, from which means the trays are suspended in a continuous chain and which have gear members (5) with horizontal and parallel axes, with the aid of an extracting device (56) comprising at least one pusher (62) and suitable for extracting the products from the storage device when the trays are, respectively, at a discharging station. When one of the trays is at the discharging station (55) and the pusher (62) is arranged laterally to the product (63) to be extracted which is carried by this tray (20), means displace the pusher (62) parallel to the axes of the gear members (4, 5) of the transportation means (3) so as to push and slide this product on this tray parallel to these axes in order to extract this product at one of the transverse ends of this tray.

17 Claims, 8 Drawing Sheets

1
49
2
7
52
63
63
45
46
4
6
20
14
43
50
40
16
25
17
36
22
55
24
20
62
63
54
53
63
48
38
23
37
13
57
58
56
5
8
9
39
3
3

PROCESS AND APPARATUS FOR THE AUTOMATIC DISPENSING OF PRODUCTS, ESPECIALLY OF FOOD PRODUCTS, IF NECESSARY REHEATED

This application is a continuation of application Ser. No. 417,968, filed Oct. 10, 1989, now U.S. Pat. No. 5,147,069.

The present invention relates to the field of apparatuses for the automatic dispensing of products, in particular of packaged food products, if necessary reheated.

Apparatuses of this type are already known.

In particular, Patent FR-A-2,587,306 describes an apparatus which comprises a storage device having horizontal trays suspended at their transverse ends by two opposite chains so as to be able to be displaced in a closed circuit on two horizontally offset vertical paths, and also an ejecting device placed between these two vertical paths, this ejecting device comprising a piston rod intended to push the products carried by the trays outward when the latter are respectively at a discharging station, so as to bring the products onto a platform situated frontally with respect to one of the vertical paths of the trays. One of the main disadvantages of this known apparatus lies in the arrangement and the working direction of the ejecting device, which therefore requires a particularly complicated structure if it is desired that the two vertical paths of the trays be a short distance apart. A subsequent disadvantage results from the fact that the ejecting device is limited in its travel and can transfer the products only to a platform situated adjacent to the front side of the trays, without being able to take them any further.

A food product dispenser is more particularly described in Patent WO-A-85/04,743. This dispenser comprises superposed shelves formed by conveyor belts on which the products are stored and, at the end of these conveyor belts, a lift fitted with a conveyor belt which is used to transfer the products vertically to an oven placed in the upper part of the dispenser and to an outlet opening, one of the superposed conveyor belts being intended to carry out the transfer of the products from the lift to this outlet opening. This dispenser is particularly complicated and has long transfer times. In addition, its height depends on the number of superposed conveyor belts provided for the storage of the products.

The present invention proposes, in contrast, a process and an apparatus for the automatic dispensing of products which notably do not have the abovementioned disadvantages.

The subject of the invention is firstly a process for the automatic dispensing of products, in particular of packaged food products, arranged on trays of a storage device comprising means for transportation in a closed circuit, from which means the trays are suspended in a continuous chain and which have gear members with horizontal and parallel axes, with the aid of an extracting device comprising at least one pusher and suitable for extracting the products from the storage device when the trays are, respectively, at a discharging station.

In accordance with a subject of the present invention, the process consists, when one of the trays is at the discharging station and the pusher is arranged laterally to the product to be extracted which is carried by this tray, in displacing this pusher parallel to the axes of the gear members of the transportation means so as to push and slide this product on this tray parallel to these axes in order to extract this product at one of the transverse ends of this tray.

In an alternative form, the process of the invention consists in bringing the pusher laterally to the product to be extracted by vertically displacing, relative to one another, this pusher and the tray carrying this product to be extracted.

Preferably, the process of the invention consists, the pusher being outside the path of the trays, in bringing one of the trays into a position close to the discharging station, in displacing the pusher parallel to the axes of the gear members so as to bring this pusher behind a product to be extracted which is carried by this tray, and in bringing the tray to the discharging station in which the pusher is arranged behind and laterally to this product to be extracted.

In accordance with a further subject of the invention, after its extraction from the storage device, the pusher may advantageously slide the extracted product as far as the hearth of an oven.

The subject of the present invention is also an automatic dispenser of products, in particular of packaged food products, especially for implementing the abovementioned process. This dispenser comprises a storage device comprising trays carrying the products, these trays being suspended in a continuous chain from transportation means having gear members with horizontal and parallel axes and suitable for displacing these trays on a path in a closed circuit; and an extracting device comprising a movable pusher suitable for acting laterally on the products to be extracted from the storage device when the trays are respectively at a charging (sic) station.

In accordance with a subject of the invention, the extracting device comprises means suitable for displacing said pusher parallel to the axes of the gear members of the storage device so as to extract the products at one of the transverse ends of the trays.

In an alternative embodiment, the means for suspending the trays from the transportation means are recessed so as to permit the passage of the pusher and the products to be extracted when they are respectively at the discharging station.

In a preferred embodiment, the means for suspending the trays comprise inverted L-shaped arms which extend perpendicularly to the abovementioned gear axes, the lower ends of the vertical branches of these arms being fixed to the trays and their horizontal upper branches being connected to the transportation means, respectively.

In an alternative form, the arms of each of the pairs of arms comprise branches articulated laterally on the tray, which branches, at the discharging station, extend level with or below the upper face of the tray so as to permit the passage of the pusher and the products to be extracted.

According to the invention, said transportation means may advantageously comprise two parallel endless elements which are arranged outside the transverse ends of the trays. Preferably, the means for suspending each tray comprise two pairs of arms which extend in planes perpendicular to the axes of the abovementioned gear members, one of the ends of the arms of each pair of arms being articulated laterally on the tray by one and the same pin, whereas their other ends are carried respectively by the endless elements at two places spaced in the longitudinal direction of the latter.

According to a further subject of the invention, the extracting device comprises a horizontal guide extending outside the path of the trays and parallel to the axes of the gear members, and also an arm extending perpendicularly to these axes and forming said pusher, this arm being mounted so as to slide on this guide with the aid of actuating means.

According to a further subject of the invention, said transportation means comprise notched endless elements mounted on toothed gear wheels and inner guides having continuous guide surfaces, on which the notches of said endless elements come to bear along their entire path, these guides having a part adjacent to the gear wheels and being, if necessary at at least two parts, adjustable relative to one another at the same time as the gear wheels.

In addition, outer guides preferably have guide surfaces, against which said endless elements come to bear.

According to a further subject of the invention, the dispenser comprises means for guiding the trays along their path so as to keep these trays horizontal.

In a simple alternative embodiment, these guide means comprise at least one guide member fixed to each tray and also rails, against which parts of the guide members bear successively as the trays move, the rails, corresponding to the paths of the trays along the gear members being movable.

In one case, the rails corresponding to the paths of the trays along the gear members may be outwardly movable counter to springs.

In another case, the movable rails corresponding to the paths of the trays along the opposite gear members are connected so as to be displaced in opposite directions under the effect of the guide members.

In an alternative form, the guide member may comprise at least one star fixed to the tray and having branches offset in the direction of the axes of the gear members (4, 5), these branches coming to bear on the rails (32, 33).

According to the invention, the guide member preferably comprises two pairs of rollers coming to bear successively on the rails.

According to a further subject of the invention, the dispenser comprises in addition an oven, the hearth of which is placed laterally to the discharging station. The abovementioned extracting means are preferably adapted so that said pusher brings the products extracted from the storage device onto the hearth of this oven.

In an alternative form, the oven has two lateral access openings offset in its peripheral direction, one of which is turned toward the discharging station.

According to a further subject of the invention, the dispenser is arranged in a cabinet having two compartments situated one beside the other and separated by a partition, one of these compartments enclosing the storage device and the other the oven, this partition having an opening for the passage of the extracting means and the extracted products.

Advantageously, the lateral wall of the oven may have two openings offset vertically and in the peripheral direction, this lateral wall being vertically movable, with the uppermost opening being on the side of the discharging station and being opposite the separating partition when the other is level with the hearth of the oven, and the lowermost opening being below the hearth when the other is level with the latter.

The subject of the present invention is in addition an automatic dispenser of products, especially of packaged food products, which comprises a device for storing the products, an extracting device suitable for extracting the products from the storage device and bringing them to a heating device and in which the heating device is an oven which comprises a hearth onto which the products to be heated are brought, and also a lateral wall vertically movable so as to open or close this oven.

According to a further subject of the invention, the lateral wall of the oven is suitable for extending around the hearth and has two access openings offset in the circumferential direction and offset vertically, these openings being situated below the hearth when the lateral wall is at its low position, the uppermost opening being turned toward the discharging station of the storage device.

In a particularly simple alternative embodiment, the lateral wall of the oven constitutes the lateral wall of a vertically movable hood.

The present invention will be better understood on studying an automatic dispenser of food products which is described by way of a nonlimiting example and illustrated diagrammatically in the drawing, in which:

FIG. 10 and FIG. 11 shows, in a view corresponding to FIG. 2, an alternative embodiment of the dispenser.

Figure 1:
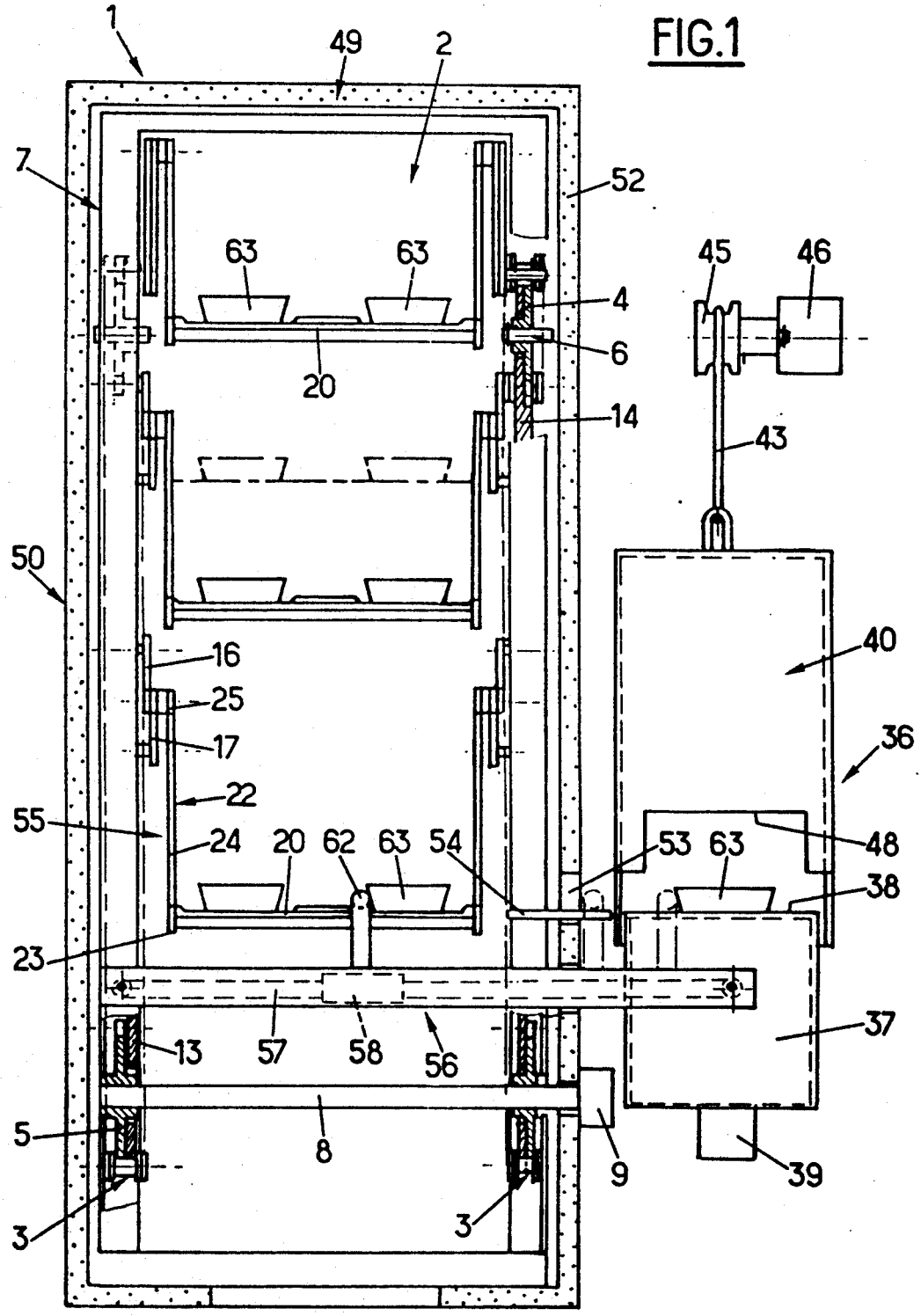
FIG. 1 represents a front view of the dispenser, the cabinet enclosing the latter being shown partially and in section.

The automatic dispenser of food products which is represented in the figures and indicated generally by the reference numeral 1 comprises a storage device indicated generally by the reference numeral 2.

This storage device 2 comprises transportation means formed by two opposite and parallel endless chains extending in transverse vertical planes and situated at a distance from one another. These chains are respectively mounted on upper toothed wheels 4 and on lower toothed wheels 5 which constitute gear members, the upper wheels 4 and the lower wheels 5 being respectively on horizontal and parallel geometric axes, in such a way that the chains 3 have respectively two opposite vertical strands. The upper wheels 4 are respectively mounted on longitudinal shaft ends 6, the outer ends of which are carried by a frame or mounting indicated generally by the reference numeral 7. The lower wheels 5 are fixed on a longitudinal shaft 8, the outer ends of which are carried by the frame 7 and one of the ends of which is capable of being driven in rotation by an electric motor 9, this motor 9 enabling the chains 3 to be driven simultaneously and in parallel via the shaft 8.

Figure 3:
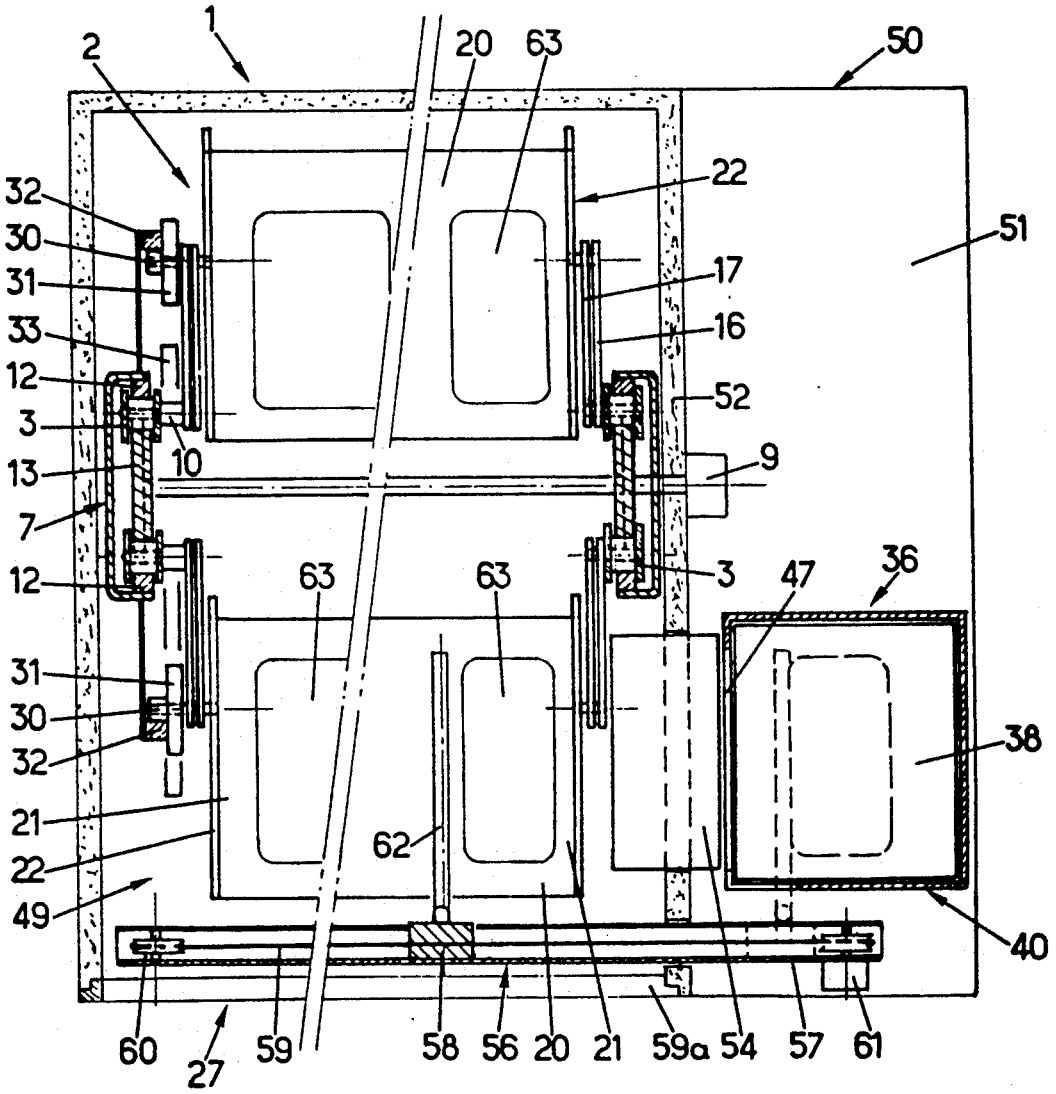
FIG. 3 represents a horizontal section through the dispenser of FIG. 1.
Figure 5:
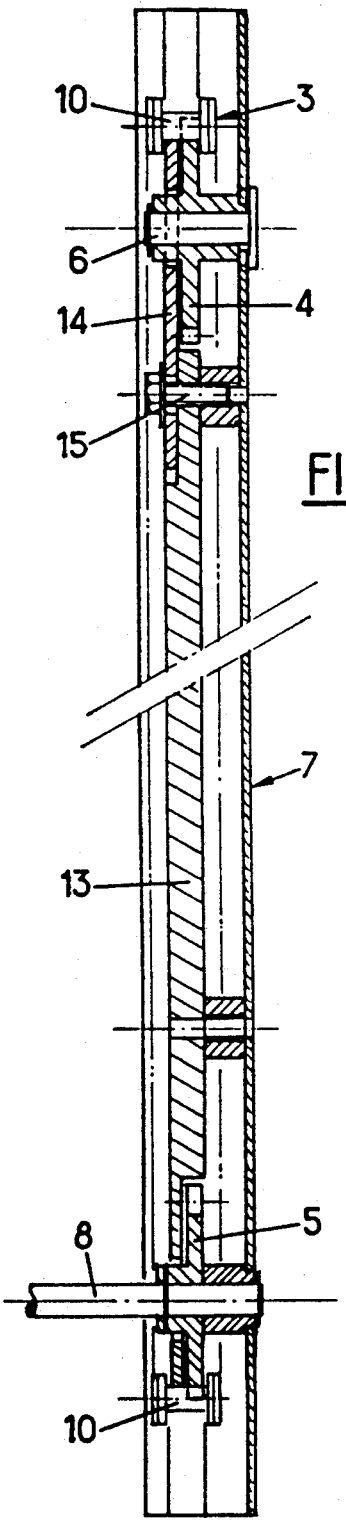
FIG. 5 shows a median vertical section through the partial view represented in FIG. 5 (sic)
Figure 4:
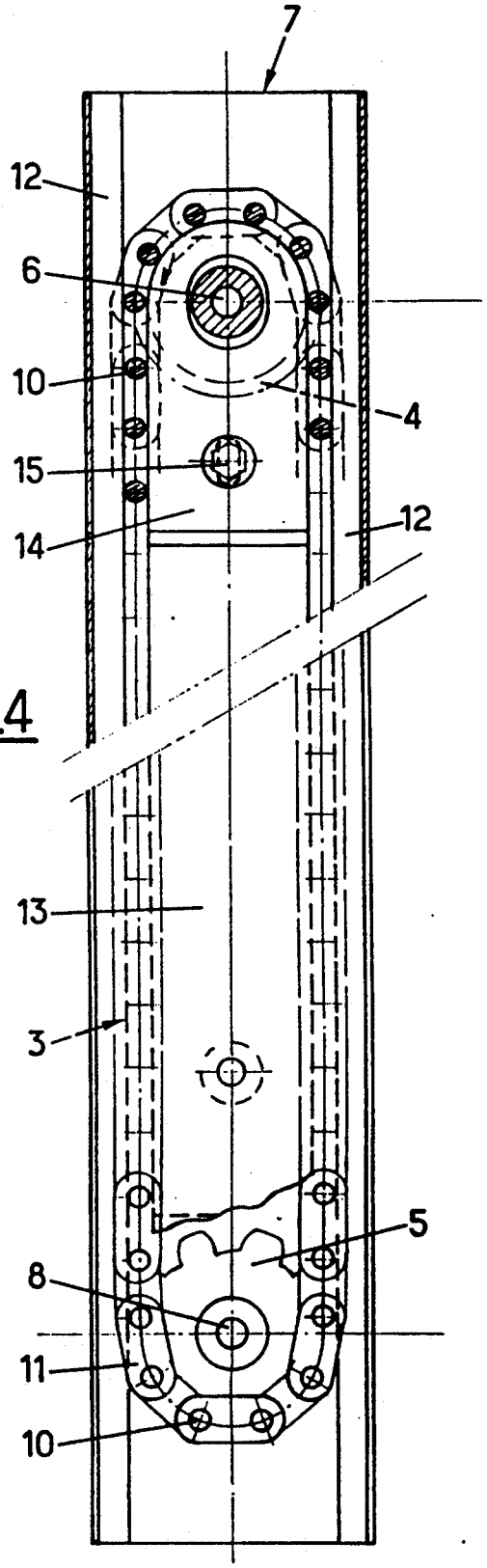
FIG. 4 represents a partial side view of the dispenser of FIG. 1.
Figure 6:
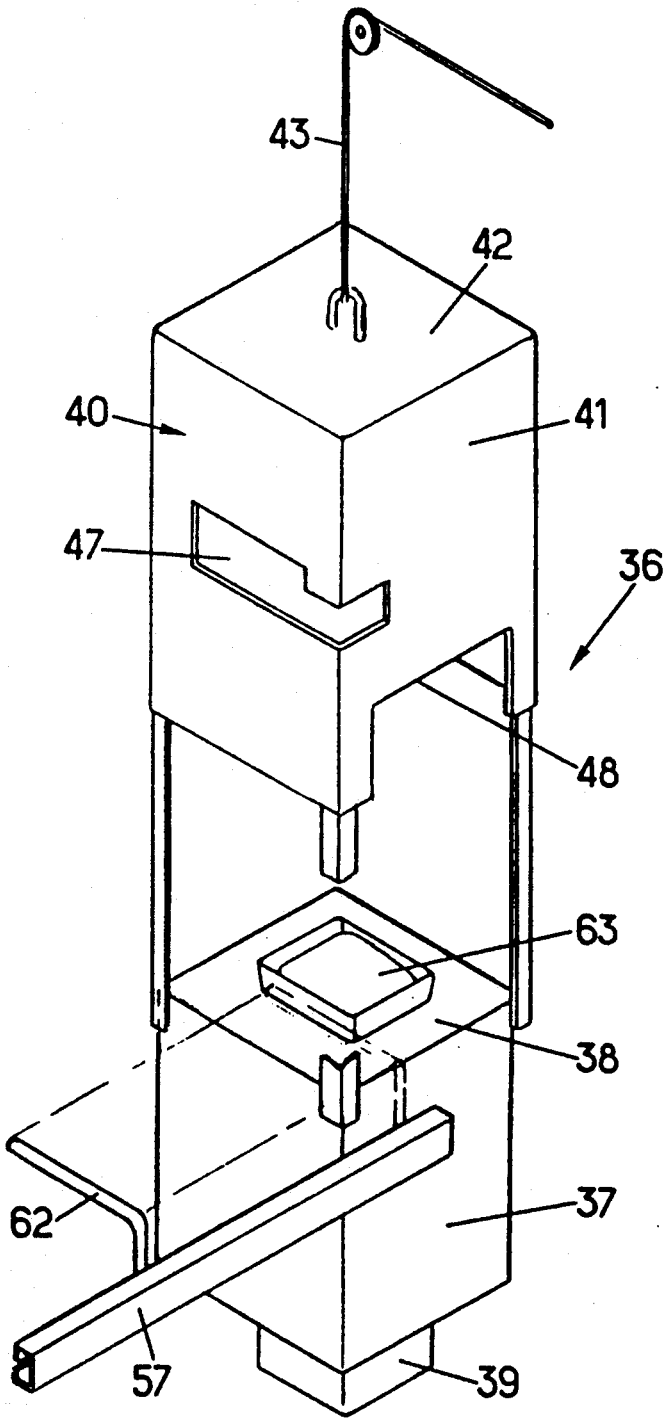
FIG. 6 shows in perspective the oven of the dispenser represented in FIG. 1.

As can be seen in FIGS. 3, 4 and 5, the pins 10 of the links 11 of the chains 3 bear on continuous surfaces for guiding pairs of vertical outer guides 12 which prevent the vertical strands of these chains 3 from becoming outwardly offset. In addition, all of the links 10 of the chains 3 bear on continuous guide surfaces of inner guides, at two parts 13 and 14, which are vertically adjustable relative to one another and which extend respectively laterally to the upper toothed wheels 4 and to the lower toothed wheels 5 so as to come into contact with the links 10 engaged in the teeth of the toothed wheels 4 and 5, these guides 13 and 14 preventing the chains 3 from becoming inwardly offset. It can be seen in FIGS. 4 and 5 that the guides 13 and 14 are adjustable relative to one another at the same time as the separation of the upper wheels 4 and the lower wheels 5, and are fixed to the frame 7 by means of screws 15. Thus, the chains 3 are completely guided over their entire paths.

Figure 2:
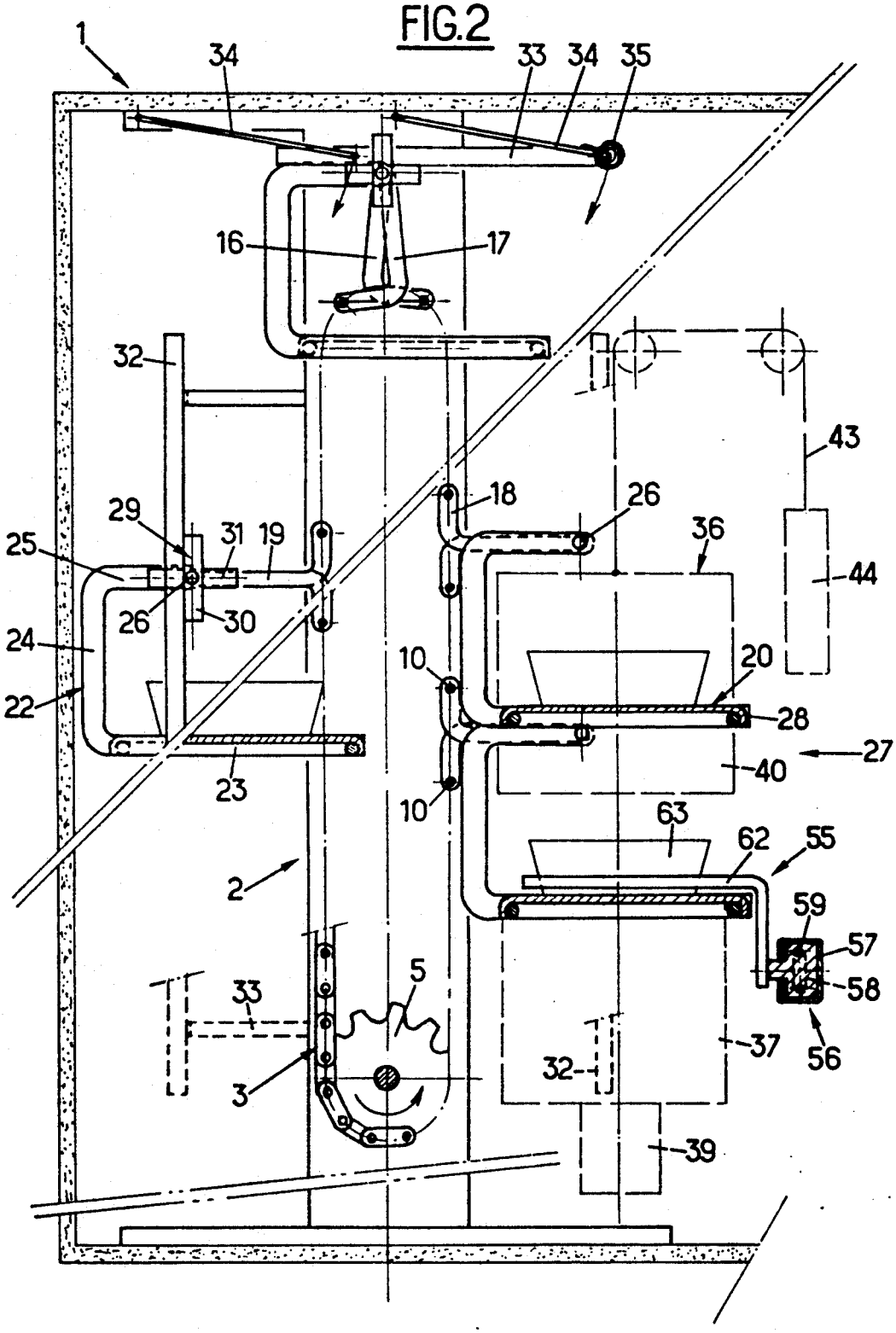
FIG. 2 represents a side view of the dispenser of FIG. 1, its upper part in external view and its lower part being in cross section.

With reference now to FIGS. 1 to 3, it can be seen that there are fixed, to certain link pins 10 of the chains 3 on their opposite sides, corresponding pairs of suspension arms 16 and 17 which are regularly spaced along the circumference of the chains 3. These arms 16 and 17 are L-shaped, extend in transverse planes and are situated between the chains. They have branches 18 which extend toward one another and branches 19 which extend outward, these branches 19 being, in the longitudinal direction, adjacent and horizontal when the pairs of arms 16 and 17 are along the vertical paths of the chains 3.

The storage device 2 comprises in addition rectangular trays 20 having a horizontal upper surface, the transverse end edges 20 (sic) of which are carried by suspension elements 22 mounted in articulated manner on the outer ends of the branches 19 of the pairs of arms 16 and 17 connected to the chains 3. These suspension elements extend in transverse planes and are recessed in such a way that the transverse end edges 21 of the trays 20 are free. They comprise horizontal lower arms 23 extending below the edges of the trays 20, arms 24 extending upward and horizontal upper arms 25 extending above and at a distance from the upper faces of the trays 20, the ends of the upper arms 25 being mounted in articulated manner on the ends of the outer arms 19 of the pairs of arms 16 and 17, via longitudinal joining pins 26 fixed to the arms 25. The elements 22 are arranged internally relative to the pairs of arms 16 and 17.

As can be seen in FIGS. 1 to 3, when the suspended trays 20 are carried by the vertical strands of the chains 3, situated on the front side 27 of the storage device 2, the trays 20 are outside the vertical plane passing through these strands, in such a way that the transverse edges 20 (sic) of these trays are, in the longitudinal direction of the axes of the wheels 4 and 5, open or free and their longitudinal and front edges 28 are likewise open and free.

As can be seen in FIGS. 2 and 3, the joining pins 26 situated on the left side in the front view according to 27 carry, outside the branches 19 of the pairs of arms 16 and 17, fixed stars 29 which have respectively vertical branches 30 and horizontal branches 31. When the trays 20 are displaced along the vertical arms of the chains 3, the vertical branches 30 of these stars 29 are guided and bear on outer vertical guides 32 fixed to the frame 7. In addition, before the links 10 carrying the pairs of arms 16 and 17 move round the toothed wheels 4 and 5, the horizontal branches 31 of the stars 29 come to bear on transverse horizontal guides 33, one of which is placed at the upper part and the other of which is placed at the lower part. These horizontal guides 33 are mounted on pivotable parallel arms 34 so as to be able to move vertically under the effect of the movement of the stars 29. Springs 35 oppose respectively the upward displacement and the downward displacement of the upper and lower horizontal guides 33.

Thus, the vertical branches 30 and the horizontal branches 31 of the stars 26 (sic), by coming to bear on the vertical guides 32 and the horizontal transverse guides 33, keep the trays 20 horizontal.

The automatic dispenser 1 represented in the FIGS. comprises in addition an oven, indicated generally by the reference numeral 36, which is arranged laterally to the front path of the trays 20, to the right of this path in the front view according to 27.

This oven 36 comprises a lower body 37 the horizontal upper face 38 of which constitutes the hearth, square in the example, this lower body 37 enclosing a heating means such as a microwave heating means 39.

The oven 36 comprises a covering hood 40 which has a vertical lateral wall 41 and also an upper horizontal wall 42. This hood 4 (sic) is suspended from a cable 43 connected to a counterweight 44, one of its gear wheels 45 being connected to an electric motor 46 so as to provide its vertical movement. The cross section of the lateral wall 41 of the hood 40 is such that the latter is able to surround the hearth 38 and slide along the body 37.

The transverse face of the lateral wall 41 of the hood 40 turned toward the storage device 2 has an opening 47 which extends slightly onto the front face of this lateral wall 41. This front face of the lateral wall 41 has an opening 48 which is offset downward relative to the opening 47.

As can be seen in particular in FIGS. 1 and 3, the storage device 2 is arranged in a compartment 49, with insulating walls, of a cabinet 50 which has an adjacent compartment 51 in which the oven 36 and also the motor for driving the chains 3 are arranged. The transverse and vertical wall 52 separating the compartments 49 and 51 has an opening 53 through which extends a transfer plate 54 the upper face of which is horizontal and extends level with the hearth 38 of the oven 36, the opening 53 being clear above this transfer plate 54. In the front view according to 27, the right edge of the transfer plate 54 extends at a distance from the left edge of the hearth 38 of the oven 36 so as to permit the passage of the lateral wall 41 of the hood 40, and its left edge extends at a short distance from the vertical path of the trays 20, without obstructing the passage of the pairs of arms 16 and 17 situated on this side.

The upper faces of the transfer plate 54 and of the hearth 38 of the oven 36 determine the vertical position of a discharging station 55, in which the upper face of each tray 20 can be brought into horizontal correspondence.

The dispenser 1 comprises in addition an extracting device indicated generally by the reference numeral 56. This extracting device 56 comprises a longitudinal profiled member 57 which extends horizontally in front of the front and vertical path of the trays 20, through the transverse wall 52 of the cabinet 50 and in front of the body 37 of the oven 36. This profiled member 57 of C-shaped cross section encloses a slide 58 which is fixed to one of the strands of a cable 59 mounted on two gear wheels 60 mounted at the longitudinal ends of the profiled member 56, one of these wheels being capable of being driven in rotation by virtue of an electric motor 61 so as to displace the slide 58 longitudinally in one direction or the other. This slide 58 carries a horizontal arm 62 which extends transversely so as to pass through the vertical and front path of the trays 20. When the slide 58 is displaced longitudinally, the arm 62, which constitutes a pusher, horizontally sweeps the vertical and front path of the trays 20, sweeps, at a short distance therefrom, the upper face of the transfer plate 54 and also the upper face of the hearth 38 of the oven 36 over at least one part, the opening 59 provided in the transverse wall 52 of the cabinet 50 being suitable for permitting the passage of this pusher 62.

As can be seen especially in FIGS. 1 and 3, the trays 20 are intended to receive food products 63, for example packaged on plates with raised edges, it being possible for each tray to carry, in the example, two products 63 spaced in the longitudinal direction. The compartment 49 of the cabinet 50 preferably constitutes a compartment for freezing the products 63, means being provided for this purpose but not being represented in the FIGS. In order to fill the storage device 2 and consequently arrange products 63 on the trays 20, the compartment 49 has an access door 59*a* provided in its front face.

The device represented in the FIGS. which has just been described functions in the following manner.

In a ready position, the pusher 62 of the extracting device 56 extends above the transfer plate 54 and the hood 40 of the oven 36 is immobilized vertically in an intermediate high position, represented in FIG. 10, in which its opening 47 extends opposite the transverse partition 52 of the cabinet 50 and not opposite its opening 53, and its front opening 58 (sic) extends below the hearth 38. The enclosure of the oven 36 is therefore not accessible and the opening 53 of the transverse partition 52 is to all intents and purposes locked.

In a first stage, the motor 9 drives the chains 3 which displace, on their path, the trays 20 so as to bring a selected tray 20 a short distance from the discharging station 55 into a position such that the upper edge of the products 63 stored on this tray is below the horizontal path of the pusher 62.

In a second stage, the motor 61 of the extracting device 56 displaces the pusher 62 so as to bring the pusher 62 behind the product 63 situated furthest to the right in the front view according to 27, as shown in FIG. 3.

In a third stage, the motor 9 drives the chains 3 so as to lift the tray 20 up to the discharging station 55 in which the pusher 62 is located behind the lateral wall of the product 63, as shown in FIGS. 1 and 2.

Figure 7:
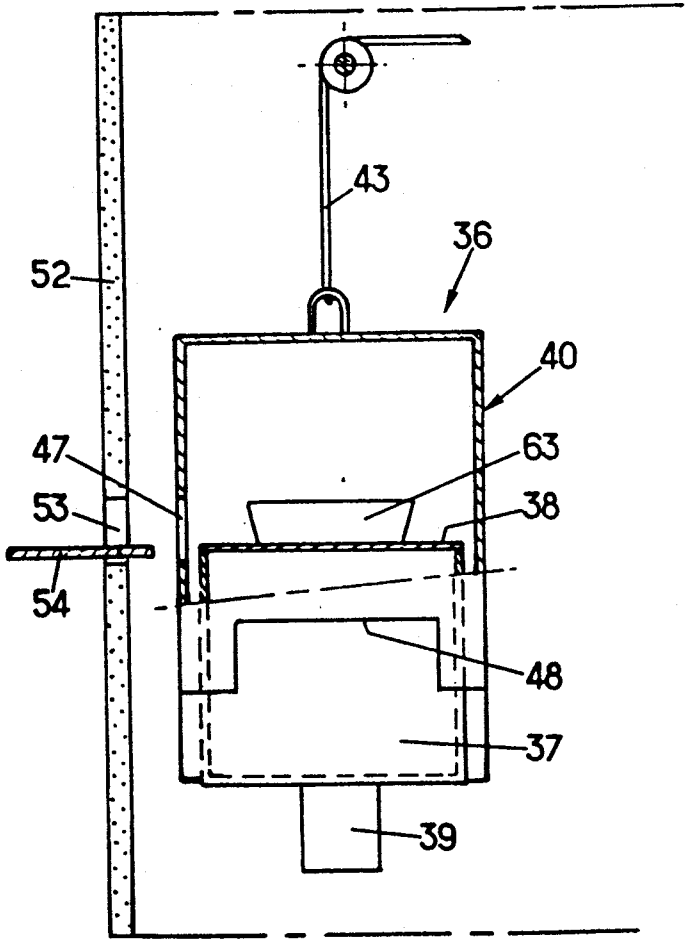
FIG. 7 shows a front view, partially in section, of this oven, in the charging position.

In a fourth stage, the motor 46 displaces the hood 40 of the oven 36 downward so as to bring its opening 47 into the intermediate low position evident in FIG. 7, facing the opening 53 of the transverse wall 52 of the cabinet 50. This fourth stage may be executed simultaneously with the preceding stages.

In a fifth stage, the motor 61 of the extracting device 56 drives the pusher 62 from left to right in the front view according to 27 so as to push and slide the product 63 longitudinally, that is to say parallel to the axes of the gear wheels 4 and 5 of the chains 3, on the upper face of the tray 20 in order to extract this product via its right transverse edge 21. The pusher 62 continues its movement and slides the product 63 onto the upper face of the transfer plate 54 by causing it to pass through the opening 53 provided in the transverse partition 52 of the cabinet 50, then onto the hearth 38 of the oven 36 by causing the product 63 to pass through the opening 47 of the lateral wall of the hood 40 and by engaging in this opening so as to bring the product 63 substantially to the middle of the hearth 38, as shown in FIG. 3 in dotted lines.

In a sixth stage, the motor 61 of the extracting device 56 drives the pusher 63 (sic) in the opposite direction until it is brought into its ready position above the transfer plate 54.

Figure 8:
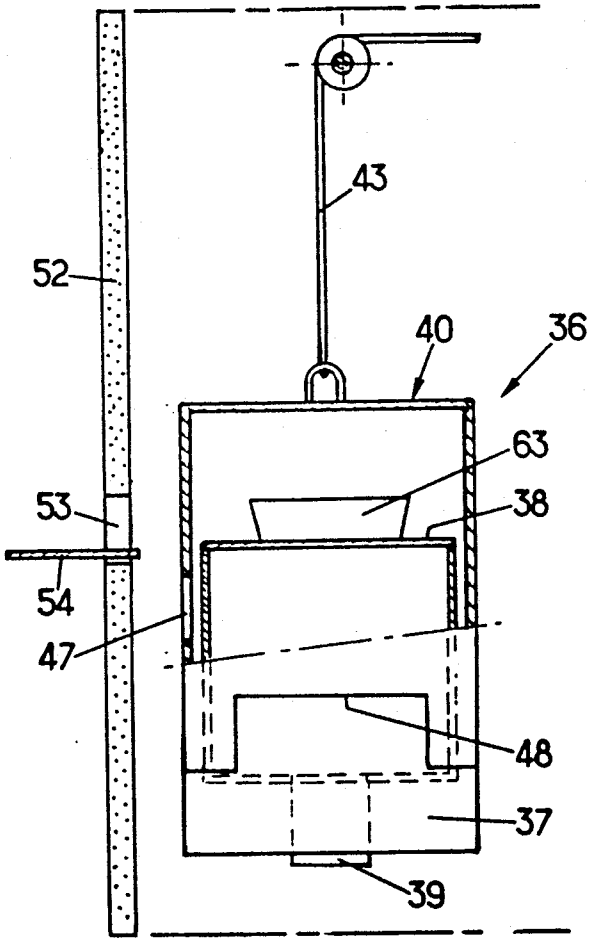
FIG. 8 shows a front view, partially in section, of this oven in the heating position.

In a seventh stage, the motor 46 drives the hood 40 of the oven 36 so as to lower it down to its low closed position, represented in FIG. 8, in which its lateral openings 47 and 48 are both situated below the level of the hearth 38, the enclosure of the oven 36 being completely closed.

In an eighth stage, the heating means 39 of the oven 36 is switched on so as to reheat the previously introduced product 63.

Figure 9:
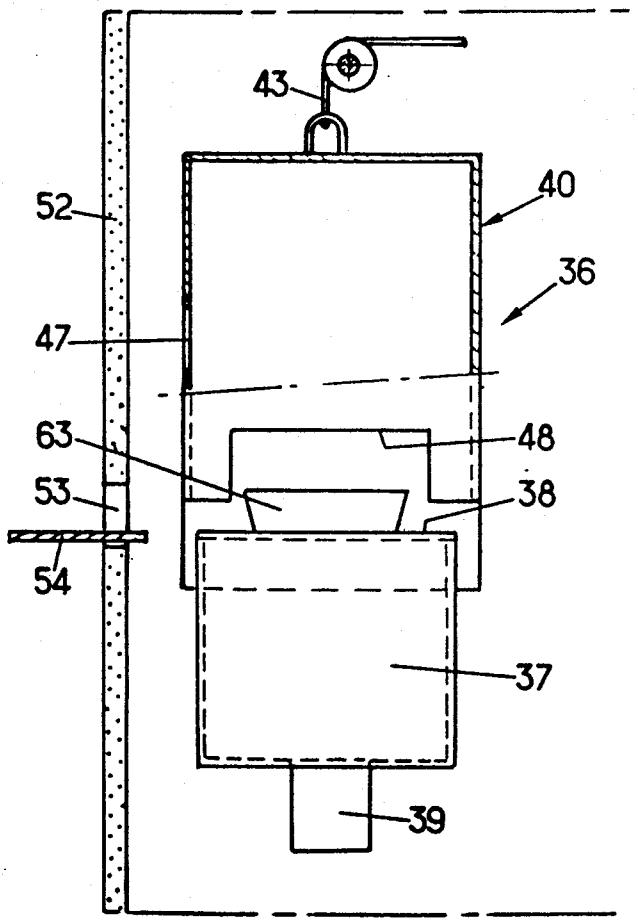
FIG. 9 shows a front view, partially in section, of this oven in the discharging position.

In a ninth stage, when the product 63 has reached a desired temperature, obtained for example by a predetermined heating time, the motor 46 drives the hood 40 of the oven 36 so as to displace it up to its high position, represented in FIG. 9, in which its front opening 48 extends level with and above the hearth 38. In this position, it is possible to remove through this opening 48 the product 63 which has been left and reheated in the oven 36. In order to carry out this operation, the front wall of the cabinet 50 has a front access door situated opposite this opening 48, this door not being represented in the FIGS.

Figure 10:
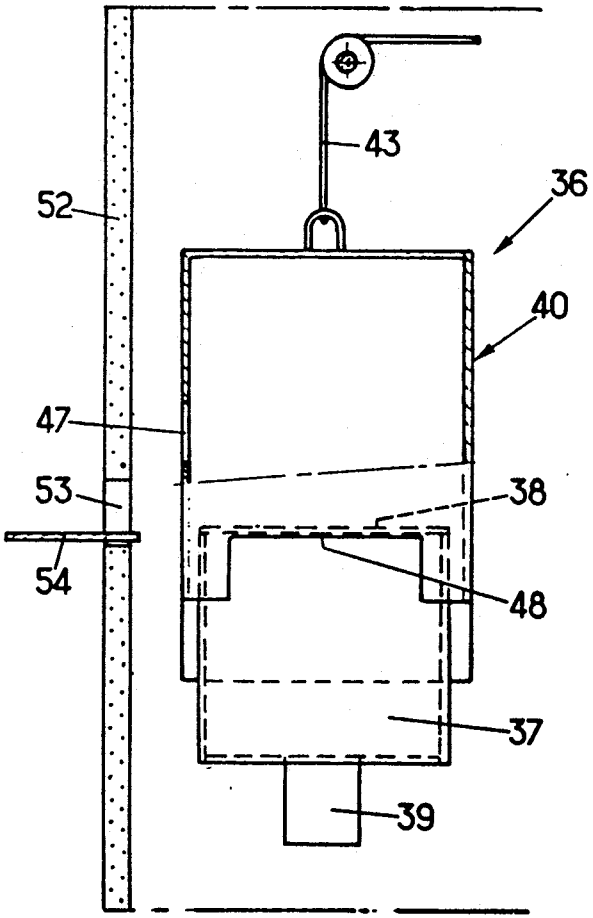
FIG. 10 shows a side view, partially in section, of this oven in the ready position.

In a tenth stage, the motor 46 again lowers the hood 40 of the oven 36 down to its intermediate high ready position evident in FIG. 10.

The operating process of the automatic dispenser 1 described above can be repeated so as to extract each of the products 63 arranged on the trays 20 of the storage device 2 in order to bring them into the oven 36 and then extract them from the latter. Since it is advantageous to arrange, in the longitudinal direction, a plurality of products 63 on the trays 20, the travel of the pusher 62 of the extracting device 56, to the left in the front view according to 27, is adapted so that this pusher 22 (sic) comes behind the remaining product situated furthest to the right.

The operating process of the automatic dispenser 1 is preferably controlled by a computer, not represented in the FIGS. This computer could include data concerning the nature of the products 63 arranged on the various trays 20 of the storage device 2 and could be connected to selector buttons, allowing the product 63 to be selected which it is desired to extract from the storage device 2 and reheat in the oven 36. A coin-operated or card-operated paying means could also be associated with this computer, in such a way that a user, having paid the amount due then selected a product 63, could have this selected product 63 delivered automatically.

Figure 11:
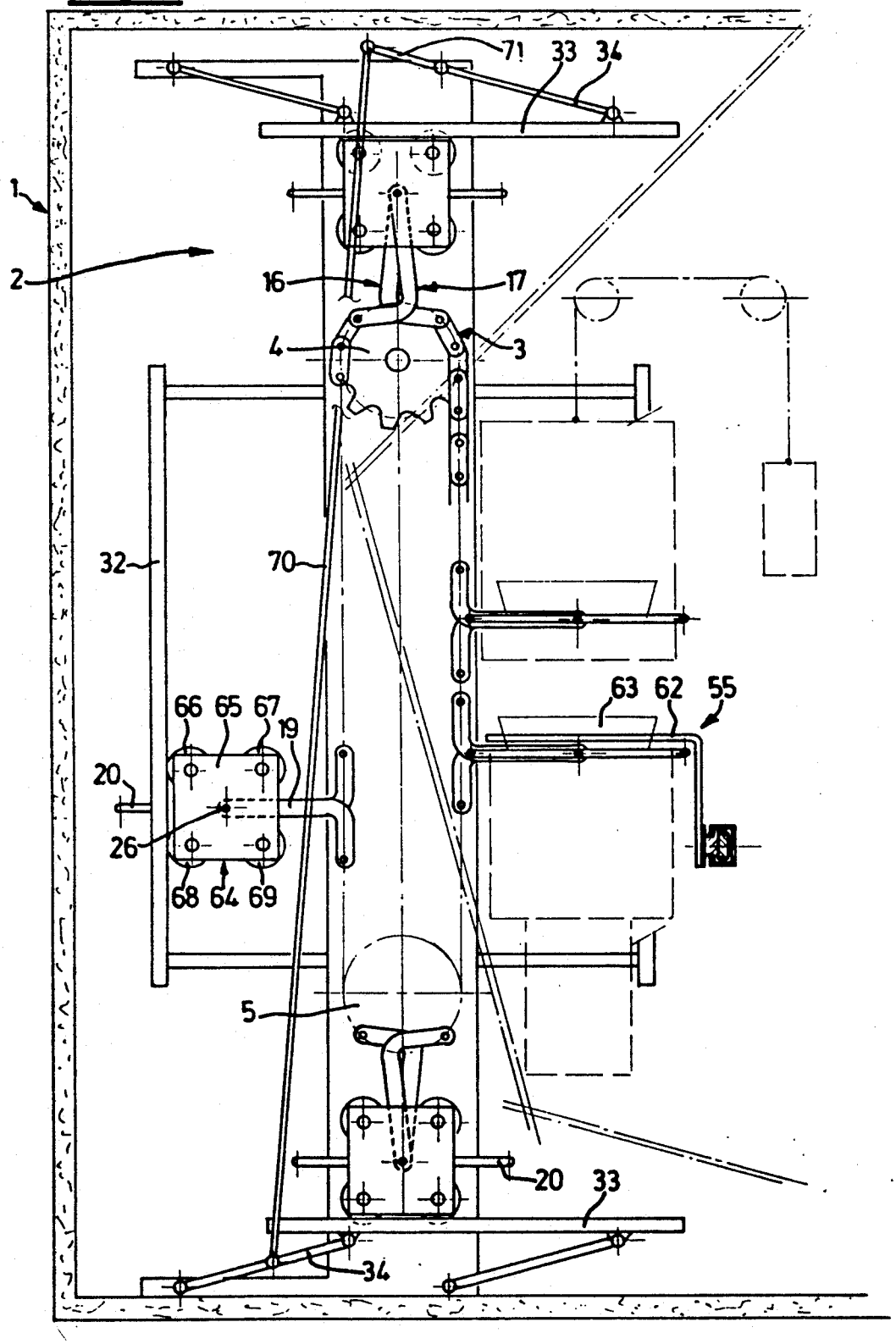

With reference now to FIG. 11, an alternative embodiment of the above-described storage device 2 will be described, in which certain parts have been modified in the following manner.

The suspension elements 22 are emitted. The pins 26 for joining the branches 19 of the pairs of arms 16 and 17 carry directly, in this alternative form, the trays 20 laterally, in such a way that when the trays 20 are at the discharging station 55, the branches 19 extend laterally to these trays and do not obstruct the movement for extracting the products 63. For this reason, at the discharging station 55, the upper edges of the branches 19 are situated level with or below the upper face of the trays 20.

The stars 29 which served to keep the trays in the horizontal position are emitted and are replaced by guide members 64 which perform the same function. These guide members 64 have respectively square plates 65 which are mounted, in articulated manner at their centre, on the outer ends of the joining pins 26 and which carry, in their corners, four rollers 66, 67, 68 and 69. When the trays 20 are displaced vertically, the rollers 66 and 68 bear against the vertical rail 32 or the rollers 67 and 69 bear against the opposite vertical rail 32 and, when the trays 20 move round the upper and lower toothed wheels 4 and 5, it is the rollers 67 and 68 and the rollers 68 and 69 which come to bear respectively against the upper and lower transverse rails 33.

In addition, the upper and lower transverse rails 33 are connected by a connecting rod 70 which displaces them in opposite directions. For this reason, the lower end of the connecting rod 70 is mounted in articulated manner on one of the pivotable arms 34, between its articulated ends, and the upper end of the connecting rod 70 is mounted in articulated manner at the end of an extension 71 of one of the pivotable arms 34, outside the axes of articulation of the latter.

The trays 20 are appropriately distributed along the chains 3, in such a way that, as they move around the wheels 4 and 5, the guide members 64 of two opposite trays 20 are simultaneously in contact with the upper and lower transverse rails 33 respectively, its (sic) transverse rails carrying out movements in opposite directions. Thus, the springs 35 may be emitted.

The present invention is not limited to the example described above. Many alternative embodiments are possible without departing from the scope defined by the attached claims.

I claim:

1. A process for automatically dispensing packaged food products from a machine having gear members with parallel horizontal axes, a continuous chain engaged with said gear members, product-supporting trays suspended from said chain, said trays having transverse ends, said trays and products thereon being movable in closed circuit paths which include a discharging station, and an extracting device provided with a pusher for extracting products from the trays; said method including the following steps:

moving the pusher in opposite directions in one horizontal path which is parallel to the axes of the gear members, said pusher being moved from a position which is outside the path of the trays to a position which is in the path of the trays and behind the path of a product to be extracted on a tray which is at an intermediate position located close to the discharging station, moving said tray vertically from its intermediate position to a position of the discharging station until the pusher is laterally behind the product to be extracted, displacing the pusher in said horizontal path to slide the product in a direction parallel to said axes and to extract the product at a transverse end of the tray.

2. A process according to claim 1 in which there is an oven with a hearth, and the pusher is displaced until the extracted product slides onto the hearth of the oven.

3. A process according to claim 1 in which the food products are dispensed to an oven, said process including the step of positioning the pusher between the path of the trays and the oven before the pusher is moved to said position which is in the path of the trays.

4. Apparatus for automatically dispensing packaged food products, comprising, means for moving said trays and products thereon in closed circuit paths which include a discharging station, and an extracting device provided with a pusher for extracting products from the trays at the discharging station, gear members with parallel horizontal axes, at least one continuous chain engaged with said gear members, product supporting trays suspended from said chain by suspending means which are spaced from the pusher so as not to interfere with movement of the pusher when it extracts products from a tray at the discharging station, said trays having transverse ends, means for moving said pusher in opposite directions in one horizontal path which is parallel to the axes of the gear members, means for moving each of said trays first to an intermediate position and then to said discharging station, said pusher moving means moving said pusher in said one horizontal path from a portion which is outside the path of the trays to a position which is in the path of the trays and behind the path of a product which is on a tray located at said intermediate position, said tray moving means than being operable to move a tray to a position at the discharging station where the pusher is behind a product on the tray, said means for moving the pusher then moving the pusher in said one horizontal path against a product to be extracted on the tray at the discharging parallel to push and slide the product in a direction parallel to said axes and to extract the product at a transverse end of the tray, and tray guide means for maintaining said trays at a horizontal orientation at all times during their movement in their closed circuit path.

5. Apparatus according to claim 4 wherein the extracting device has a horizontal guide which is outside the path of the trays and lies parallel to the axes of the gear members, said pusher including an arm which extends perpendicular to said axes and is slidably mounted on said horizontal guide, said means for moving the pusher sliding the arm on said horizontal guide,

6. Apparatus according to claim 4 in combination with an oven provided with a hearth which is located laterally of said discharging station, said pusher being operable to extract products from the trays onto the hearth of the oven.

7. Apparatus according to claim 6 wherein the oven has two lateral access openings which are horizontally offset from each other, one of said openings facing toward said discharging station.

8. Apparatus according to claim 6 in combination with a cabinet which has two compartments situated beside each other, a partition separating said compartments, a first said compartment enclosing the gears, chains and trays; a second said compartment enclosing the oven; said partition having an opening for the passage of the extracting means and the extracted products.

9. Apparatus for automatically dispensing packaged food products, comprising, gear members with parallel horizontal axes, at least one continuous chain engaged with said gear members, product-supporting trays suspended from said chain, said trays having transverse ends, said trays and products thereon being movable in closed circuit paths which include a discharging station, and an extracting device provided with a pusher for extracting products from the trays, means for moving said pusher in opposite directions in one horizontal path which si parallel to the axes of the gear members, said means for moving said pusher being operable to move the pusher against a product to be extracted on the tray at the discharging station to push and slide the product in a direction parallel to said axes and to extract the product at a transverse end of the tray, said extracting device having a horizontal guide which is outside the path of the trays and lies parallel to the axes of the gear members, said pusher including an arm which extends perpendicular to said axes and is slidably mounted on said horizontal guide, said means for moving the pusher being operable to slide the arm on said horizontal guide, an oven provided with a hearth which is located laterally of said discharging station, said pusher being operable to extract products from the trays onto the hearth of the oven and into the oven.

10. Apparatus according to claim 9 including suspending means for connecting the trays to the chain, said suspending means being spaced from the pusher so as not to interfere with movement of the pusher when it extracts products from a tray at the discharging station.

11. Apparatus according to claim 10 wherein the suspending means includes inverted L-shaped arms which are perpendicular to said axes of the gear members; each of said arms having a vertical branch with a lower end which is fixed to a tray and a horizontal branch connected to the chain.

12. Apparatus according to claim 9 having two said continuous chains spaced from the transverse ends of the trays, suspending means for connecting the trays to the chains, said suspending means associated with each tray including two pairs of arms which lie in planes perpendicular to said axes of the gear members, both arms of each pair of arms having one end connected to the tray by a same pin, both arms of each pair of arms having their other ends connected to spaced apart places on said chain.

13. Apparatus according to claim 12 wherein both arms of each pair of arms have branches which are articulated laterally on their respective tray, said branches when at said discharging station being no higher than the tray so as to permit the pusher to pass thereover when products are extracted.

14. Apparatus according to claim 9 including tray guide means for maintaining said trays at a horizontal orientation at all times during their movement in the closed circular path.

15. Apparatus according to claim 9 wherein the oven has two lateral access openings which are horizontally offset from each other, one of said openings facing toward said discharging station.

16. Apparatus according to claim 9 in combination with a cabinet which has two compartments situated beside each other, a partition separating said compartments, a first said compartment enclosing the gears, chains and trays; a second said compartment enclosing the oven; said partition having an opening for the passage of the extracting means and the extracted products.

17. Apparatus according to claim 16 in which the oven has a vertically movable lateral wall provided with first and second openings which are offset from each other vertically and horizontally, said first opening being uppermost and facing the discharging station, said first opening being opposite the partition when the second opening is level with the hearth, said second opening being below the hearth when the first opening is level with the hearth.

* * * * *